United States Patent [19]

Dudley

[11] 4,298,476

[45] Nov. 3, 1981

[54] AIR BLADE CONSTRUCTION FOR CHIP WRINGER

[75] Inventor: Robert H. Dudley, Portage, Mich.

[73] Assignee: Reclamet, Inc., Kalamazoo, Mich.

[21] Appl. No.: 102,292

[22] Filed: Dec. 10, 1979

[51] Int. Cl.[3] ..... B01D 33/10

[52] U.S. Cl. ..... 210/373; 210/377; 233/33

[58] Field of Search ..... 233/32, 33, 38, 40, 233/44; 210/360.1, 375, 377, 380.1, 373

[56] References Cited

U.S. PATENT DOCUMENTS

| | | | |
|---|---|---|---|
| 695,158 | 3/1902 | Lafferty | 233/38 X |
| 2,456,329 | 12/1948 | Schoder | 233/33 |
| 3,233,735 | 2/1966 | Hultsch et al. | 233/25 X |
| 3,483,991 | 12/1969 | Humphrey | 210/377 |
| 4,137,176 | 1/1979 | Dudley et al. | 210/375 |
| 4,186,096 | 1/1980 | Areaux et al. | 210/377 |

FOREIGN PATENT DOCUMENTS

| | | | |
|---|---|---|---|
| 150599 | 3/1953 | Australia | 210/377 |

*Primary Examiner*—Philip R. Coe

*Attorney, Agent, or Firm*—Blanchard, Flynn, Thiel, Boutell & Tanis

[57] ABSTRACT

A centrifuge for continuously separating a lubricating liquid from lubrication-impregnated metal chips. A motor having a drive shaft thereon is mounted so that the drive shaft is drivingly coupled to a substantially bell-shaped centrifugal separator bowl having a bottom wall and an outwardly widening conical portion. The separator bowl is formed with openings intermediate the top edge and bottom wall for discharge of the liquid therethrough. A plurality of radially extending blades are mounted on a bottom wall liner in the separator bowl and are movable therewith. The upper portions of the blades have further blade segments pivotally secured thereto. The blade construction effects a movement of air into an annular collecting structure form the air inlet and out through the outlet duct to effect an entrainment of the metal chips in the air movement for discharge out through the outlet duct. The bottom wall liner is fixedly maintained relative to the conical wall structure but is angularly shiftable relative thereto either manually or in response to the blades engaging extraordinarily large pieces of metal, such as rod ends or the like.

7 Claims, 4 Drawing Figures

AIR BLADE CONSTRUCTION FOR CHIP WRINGER

FIELD OF THE INVENTION

This invention relates to a centrifuge or chip wringer and, more particularly, to an air blade construction therefor.

BACKGROUND OF THE INVENTION

Centrifuges for continuously feeding and removing liquid from lubrication-impregnated metal chips or shavings are well known in the art and the teachings in Hultsch et al U.S. Pat. No. 3,233,735, Steimel U.S. Pat. No. 3,366,318, Dudley U.S. Pat. No. 3,850,814 and Dudley et al U.S. Pat. No. 4,137,176, are representative teachings of such structures. In the latter disclosure, a plurality of blades are provided in the bottom of the separator bowl. However, these blades in the bottom of the separator bowl are inadequate for generating the desired air flow through the centrifuge. In addition, the chips have a tendency to bounce when they strike the bottom wall of the separator bowl and bounce over the top of the blades. The chips usually continue to bounce along the sidewall of the separator bowl and out through the outlet. This bouncing phenomena does not enable the blades to impart a movement with the sidewall of the chip wringer and, as a result, there is insufficient tangential velocity imparted to the chip at the time it reaches the chip discharge edge on the separating bowl. As a result, the slow moving chips will interfere with the faster moving chips and clogging of the chips at the outlet will occur.

Accordingly, it is an object of this invention to provide a blade construction inside a separator bowl which will impart a tangential velocity to a majority of the chips passing through the centrifuge and simultaneously generate a sufficient air flow to entrain the chips adjacent the outlet therein so that the chips will be thrown a substantial distance out of the outlet.

It is a further object of this invention to provide a blade construction which will generate a sufficient amount of air flow and be readily incorporated into existing separator bowls with a minimum of difficulty.

It is a further object of this invention to provide structure for mounting the blades in the bottom of the separator bowl, which structure will effect an automatic movement of the blades relative to the internal wall surface of the separator bowl in response to the blades engaging extraordinarily large objects in the metal shavings, such as rod ends, workmen's tools and the like, which, from time to time, become embodied within the metal shavings.

It is a further object of this invention to specifically provide additional blades on the blades mounted within the separator bowl for effecting greater air movement within the chamber normally provided for collecting chips so that the chips will become entrained in such air movement and driven out through an outlet duct to a distant location.

It is a further object of this invention to provide a blade support structure, as aforesaid, which can be readily included in existing equipment at a minimum of expense.

SUMMARY OF THE INVENTION

In general, the object and purposes of the invention are met by providing a motor having a rotatable drive shaft drivingly connected to a centrifuge separator bowl. The separator bowl is formed to have openings to facilitate the discharge of liquid therethrough under the action of centrifugal force. A plurality of angularly spaced first blade means are provided in the bottom of the separator bowl. These first blade means extend axially of the separator bowl to a location adjacent the metal chip discharge edge whereat a second blade means is attached. The second blade means extend into the annular chamber normally provided for collecting metal chips so that the metal chips will become entrained in such air movement and driven out through an outlet duct to a distant location.

BRIEF DESCRIPTION OF THE DRAWINGS

Further objects and purposes of this invention will be apparent to persons acquainted with apparatus of this general type upon reading the following specification and inspecting the accompanying drawings, in which.

Figure 1:
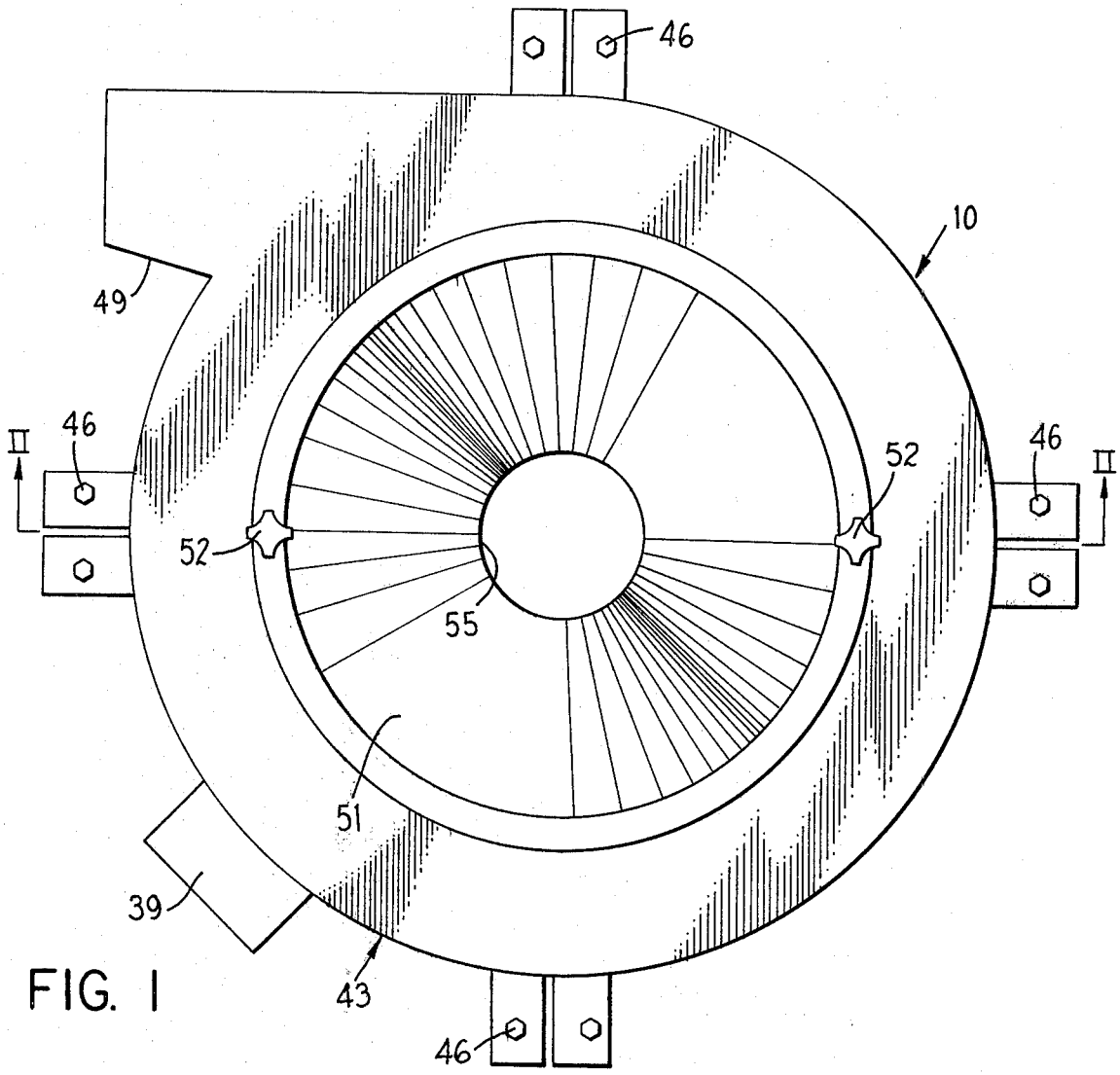
FIG. 1 is a top view of a centrifuge embodying the invention.
Figure 2:
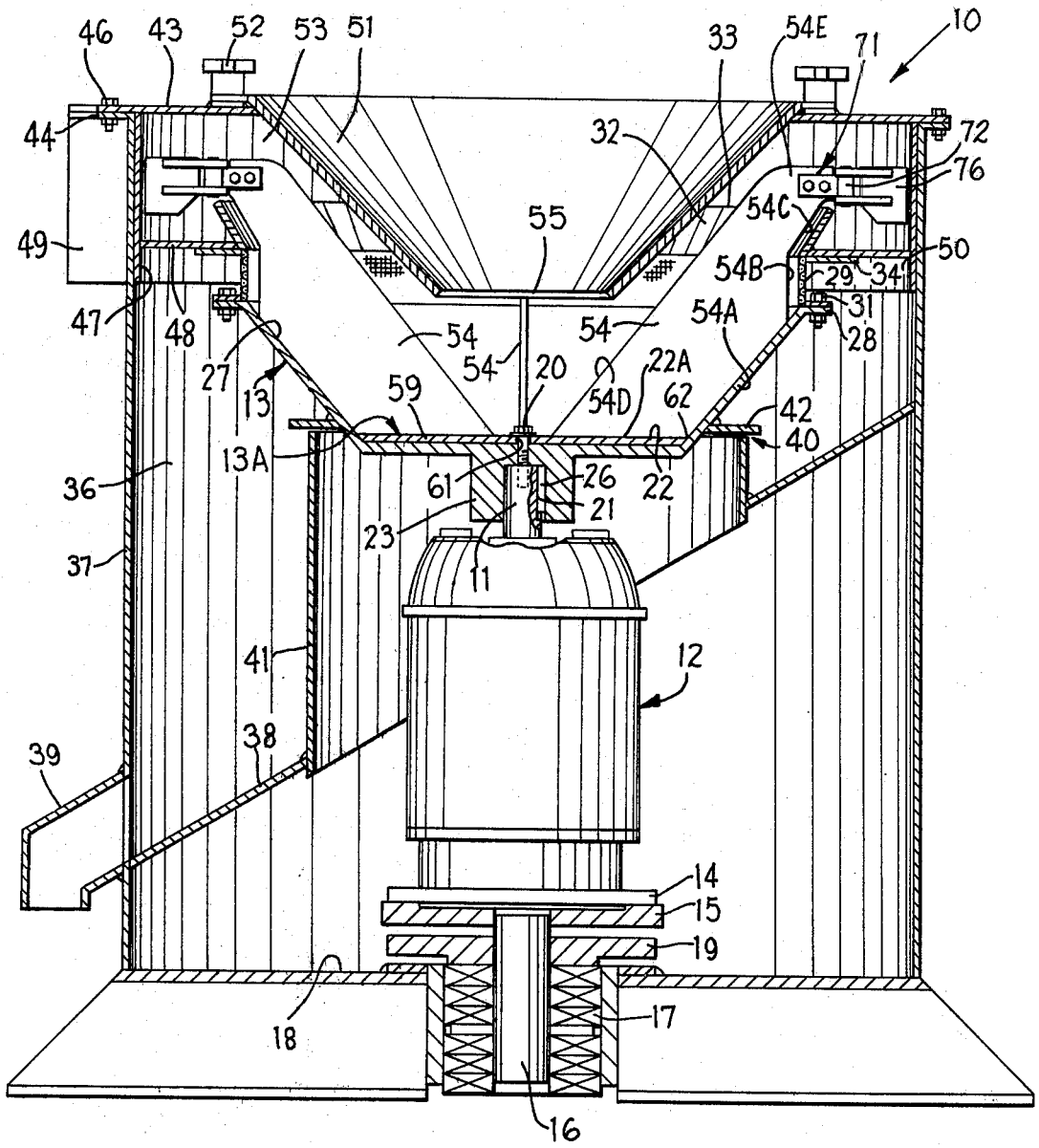
FIG. 2 is a sectional view taken along the line II—II of FIG. 1.
Figure 4:
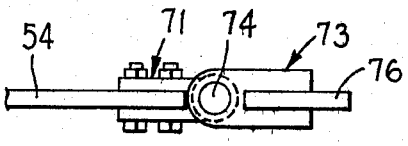
FIG. 4 is a partial top view of the blade structure of FIG. 3.
Figure 3:
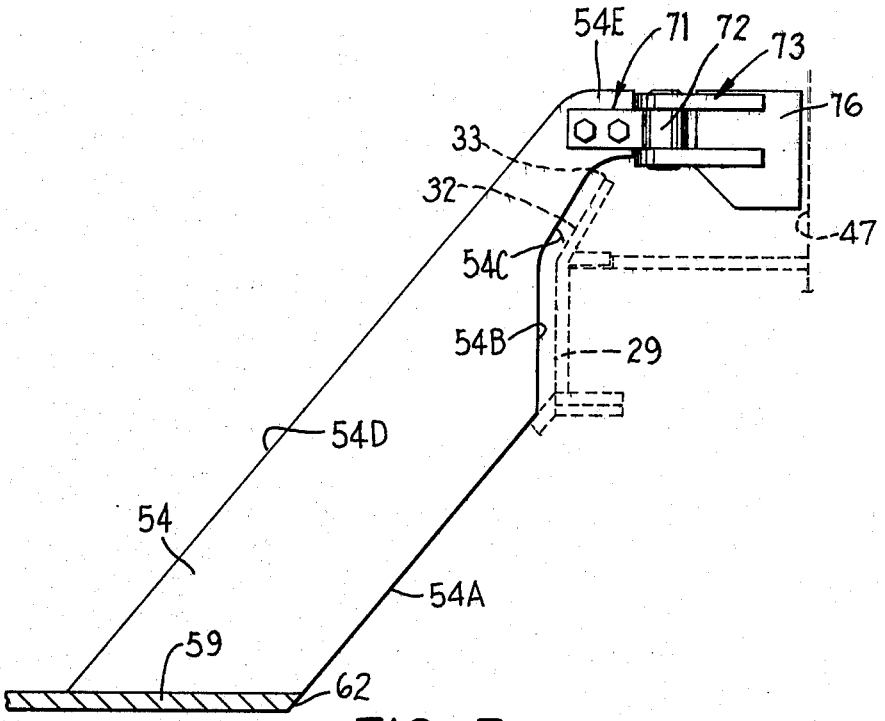
FIG. 3 is an enlarged fragmentary view of a blade structure on the bottom wall liner and embodying the invention.

Certain terminology will be used in the following description for convenience in reference only and will not be limiting. The words "up" and "down" will designate directions in the drawings to which reference is made. The words "in" and "out" will refer to directions toward and away from, respectively, the geometric center of the device and designated parts thereof. The aforementioned terminology will also include derivatives thereof and words of similar import.

DETAILED DESCRIPTION

Referring now to the drawings, it will be seen that the centrifuge 10, according to the present invention, comprises a motor 12 having a substantially vertical drive shaft 11 to the upper end of which a substantially bell-shaped centrifugal separator bowl 13 is connected for rotation with the drive shaft. Elastic mounting means are provided for mounting the motor with the drive shaft extending in substantially vertical direction and permitting the motor to vibrate transverse to its axis. The elastic mounting means may include a flange 14 secured to the lower end of the motor 12, a second flange 15 abutting against the flange 14 coaxially arranged with respect thereto and fixed thereto in any convenient manner and carrying fixably connected thereto a downwardly projecting central stud shaft 16 surrounded by a plurality of rubber rings 17 which are housed in a socket mounted in the base 18 of the centrifuge 10. The rubber rings 17 can be compressed by means of a clamping flange 19 screwed into the upper end of the socket in which the rubber rings are housed.

The end of the drive shaft 11 projecting upwardly beyond the motor 12 is preferably keyed. An internally keyed recess 21 is located in a central cavity in the bottom wall 22 of the separator bowl 13 and receives the keyed shaft 11 so as to effect a driving coupling between the shaft 11 and the separator bowl 13. In this particular embodiment, the central cavity in the bottom wall 22 of the separator bowl 13 is defined by a hub member 23. A key 26 is received in the keyway and cooperates with the corresponding keyed recess 21 in the hub 23 to effect the unitary drive between the drive shaft 11 and the separator bowl 13. The bottom wall of the separator bowl extends outwardly and upwardly to form an upwardly opening conical surface 27. A flange 28 extends radially outwardly of the upper edge of the conical surface 27. A bottom wall liner 13A is mounted in the separator bowl 13 and is removably secured by a centrally disposed bolt 20 to an internally threaded hole in the end of the shaft 11. The bottom wall liner 13A has a generally flat plate 59 with a central opening 61 therethrough. In this particular embodiment, the bottom wall 22 of the separator bowl 13 is also flat so that the plate 59 essentially covers the entirety of the bottom wall 22. A plurality of blade members 54 are secured, as by welding, to the upper surface of the plate 59. The blade members 54 are radially oriented with respect to the separator bowl 13 and are angularly spaced on the plate about the central hole 61. The radially outer edge 62 is beveled so that it conforms to the angle of the internal wall surface 27 of the separator bowl 13. The blades are of a uniform construction designed to assure the bringing up to speed of all metal shavings deposited into the separator bowl and to keep the shavings from bouncing in the bowl and out of the top without being centrifuged. The particular blade construction will be discussed in further detail below. A substantially cylindrical and porous separator bowl portion 29 defined by a wire mesh or the like, namely a portion having openings therein to permit passage of lubricant therethrough without permitting passage of shavings, extends upwardly from the flange 28 to permit a discharge of the lubricating liquid to be separated from the metal shavings in the separator bowl from the interior of the latter. The porous cylindrical portion 29 is secured to the flange 28 by means of a plurality of fasteners 31. A conical portion 32 is secured to the upper edge of the porous portion 29 and extends radially outwardly in an upward direction to a shaving dispensing edge 33 thereon. A radially extending flange 34 is secured to the centrifugal separator bowl 13 intermediate the juncture between the conical portion 32 and the porous cylindrical portion 29 and extends radially outwardly therefrom. The purpose of this flange will be explained hereinbelow.

The liquid discharged through the openings in the porous separator bowl portion 29 will be collected in a collection chamber 36, preferably constituted by a casing wall 37 surrounding the separator bowl outwardly spaced therefrom and provided with a bottom 38 which is slightly inclined toward a discharge conduit 39 communicating with the interior of the chamber 36. An annular flange 42 is secured to and extends radially outwardly from the conical portion 27 of the separator bowl 13 at a location thereon immediately above the upper edge of the cylindrical portion 41 to define a labyrinth type seal 40 to prevent the movement of particles and/or lubricant into the interior of the cylindrical portion 41 adjacent the motor 12.

A cover 43 is fixed in any convenient manner to the upper edge of the casing wall 37. In this particular embodiment, the upper edge of the casing wall 37 has a radially outwardly extending flange 44 thereon having a plurality of holes therein receiving fasteners 46 cooperating with aligned holes in the cover 43 to effect the securement of the cover 43 to the casing 37. The cover 43 is designed so as to be interchangeable with existing centrifuge structures. The cover has a downwardly extending wall, cylindrical wall 47, telescoped inside the upper edge portion of the casing 37. A radially inwardly directed flange 48 is secured to the cylindrical wall member 47 and is positioned so as to be located immediately above the radially outwardly extending flange 34 secured to the separator bowl 13 at the juncture between the porous separator bowl portion 29 and the conical portion 32. The spacing between the flanges 34 and 48 defines a labyrinth type seal 50 to prevent the movement of chips into the chamber 36. The radially inner edge of the flange 48 is spaced radially outwardly from the conical portion 32 of the separator bowl 13 to facilitate an oscillatory movement of the separator bowl 13 should it become lopsided in its loaded condition. As illustrated in FIG. 1, the cover 43 is generally circular in construction and has an outlet duct integrally formed therewith. In this particular embodiment, the cover 43 has an upper conical member 51 releasably secured thereto by a plurality of fasteners 52 so that the wall of the cone 51 defines the inner wall of a second annular shaving collecting chamber 53 and the cylindrical wall 47 defines the outer wall thereof. The upper cone 51 converges in a downwardly direction to a location spaced immediately above the plane defined by the radial flange 28 at the upper end of the conical portion 27 of the separator bowl 13. The opening 55 at the lower end of the upper cone 51 defines an air inlet as well as an inlet for shavings into the centrifuge 10.

In this particular embodiment, the blades 54 have a substantial surface area facing in the circumferential direction, which surface area extends from the upper surface of the plate 59 continuously upwardly to a location above the shaving dispensing edge 33. The blades 54 each extend across the porous cylindrical portion 29. More specifically, the bottom edge of each blade 54 is secured to the plate 59 and extends from the radially outer edge of the plate 59 radially inwardly to a location spaced slightly from the central hole 61. The radially outer edge of the blades each has a contour corresponding to the contour of the inner surface of the separator bowl 13. In this instance, the radially outer edge segment 54A extends upwardly and outwardly to fit in sliding relation to the conical surface portion 27 of the separator bowl 13. The radially outer edge segment 54B extends upwardly generally parallel to the porous cylindrical portion 29 and spaced slightly radially inwardly therefrom. The radially outer edge segment 54C extends upwardly and outwardly generally parallel to the conical portion 32 and spaced slightly radially inwardly therefrom. The radially inner edge segment 54D extends upwardly and outwardly over the entire length thereof at a slight angle to the edge segment 54A. In this instance, the angle is 10 degrees less than the angle of the edge segment 54A.

The edge segments 54C and 54D are generally parallel and terminate in a mounting portion 54E at the uppermost portion thereof. A bracket 71 is fixedly secured to the mounting portion 54E, which bracket has a pivot bearing structure 72 thereon, the pivot axis of which extends parallel to the axis of rotation of the separator drum 13. A bracket 73 is pivotally secured to the bearing structure 72 by a pin 74 extending through the bearing structure 72 and openings in the bracket 73. A blade 76 is fixedly connected to the bracket 73. The radially outer extremity of the blade 76 terminates just slightly radially inwardly of the cylindrical wall member 47.

OPERATION

Although the operation of the device embodying the invention has been indicated somewhat above, the operation will be described in detail hereinbelow for convenience purposes and to facilitate a more complete understanding of the invention.

As metal shavings impregnated with lubrication enter the cone 51 and the separator bowl 13 through the lower conical opening 55, the lubrication-impregnated shavings will fall between the blade structure 54 and a rotation of the separator bowl 13 will impart a rotational movement of the shavings. The shavings, as they gain rotational velocity, will begin to slide radially outwardly and up the conical surface 27 toward the porous cylindrical separator bowl portion 29. As the shavings slide across the porous separator bowl portion 29, lubrication contained on the shavings will be thrown radially outwardly through the holes therein and be collected in the chamber 36 for discharge through the outlet conduit 39. The chips will continue to move upwardly and radially outwardly on the conical surface 32 and be thrown radially outwardly and tangentially from the terminal edge 33 at the upper edge of the separator bowl 13. The blades 54, and if provided the blades 76, will effect an air movement within the chamber 53 and the shavings entering the chamber 53 will be entrained in the aforesaid air movement. Air will be drawn into the chamber 53 through the material inlet opening 55 in the cone 51. The air will be blown out through the outlet duct 49 and the shavings will be carried in entrainment therewith out through the outlet duct 49 toward any designated destination or by means of simple diverters to any one of several locations.

As indicated above, amongst the metal chips and shavings, which are to be centrifuged to extract the lubricating oil thereon, there are numerous rod ends, tool bits, workpieces and scrap pieces of metal. The phrase "rod ends" is a term of art meaning the end of elongated metal rods which the machine operator simply tosses into the collection of metal chips at the end of the rod being machined. In addition, the machine operator may want to dispose of scrap wherein machining mistakes have been made on workpieces. As a result, rather large pieces of metal can be found in a collection of metal shavings. An engagement by the blades 54 with the rod ends, tool bits, workpieces and scrap pieces of metal, or the like, will cause a substantial jolt or shock to be applied to the blades 54. While the central bolt 20 received in the central hole 61 effectively urges the plate 59 into tight frictional engagement with the bottom wall 22 of the separator bowl so that the plate 59 and blades 54 will be effectively moved with the separator bowl 13, the shock applied to the blades 54 by these large objects will be sufficient to incrementally move or index the plate 59 relative to the separator bowl 13. As a result, the leading surface of each of the blades adjacent the radially outermost portion thereof becomes located adjacent an unworn segment of the internal wall surface of the separator bowl. As a result, wear to the internal wall surface of the separator bowl is substantially minimized by the foregoing structure. This structure is the subject of copending applications Ser. Nos. 955 578 and 955 579, filed Oct. 30, 1978, now U.S. Pat. Nos. 4,186,096 and 4,186,097. Accordingly, further comment about this structure appears unnecessary.

In addition, the extraordinarily large pieces of metal will slide along the internal wall surface of the separator bowl and eventually exit past the shaving dispensing edge 33. At this moment in time, these large pieces will be engaged by the blades 76. A pivotal securement of the blades 76 to the axial ends of the blades 54 will prevent these large pieces from breaking the blades 76. Thus, the lifetime of not only the separator bowl, but also the blades 76 is appreciably enhanced by the aforesaid construction.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A centrifuge for continuously separating a lubricating liquid from lubrication carrying metal shavings or the like, comprising:

a motor having a rotatable drive shaft;

substantially bell-shaped centrifugal separator bowl means having an annular side wall, an end wall, a shaving dispensing edge and openings in said side wall for the discharge of liquid therethrough and being located intermediate said end wall and said shaving dispensing edge;

an inlet conduit located at an open end of said separator bowl means for facilitating a delivery of said shavings at the center of said end wall, said inlet conduit terminating at a location axially spaced from said end wall;

power transmission means for transmitting rotatable output from said drive shaft to said separator bowl means;

shaving collecting chamber means including an annular surface surrounding said shaving dispensing edge of said separator bowl means radially outwardly spaced therefrom for collecting shavings discharged by centrifugal action from said separator bowl means;

an outlet duct means connected to said shaving collecting chamber means and having a central axis extending tangential of said shaving collecting chamber means and away therefrom;

whereby said shaving collecting chamber means will collect said shavings emanating from said dispensing edge and the kinetic energy of said moving shavings will effect a movement thereof along said annular surface and into said outlet duct means for discharge thereof; and a plurality of angularly spaced blade means affixed to said end wall of said separator bowl means, said blade means extending axially of said separator bowl means away from said end wall axially across said liquid discharge openings and terminating adjacent said shaving dispensing edge, each of said blade means having a continuous circumferentially facing surface along the axial length thereof for effecting a movement of air through said inlet means, into said shaving collecting chamber means and out through said outlet duct means to effect an entrainment of said shavings in said air movement for discharge cut through said outlet duct means, each of said blade means extending radially inwardly from said side wall, at least a blade portion of said blade means adjacent said discharge openings and said dispensing edge occupying a majority of the spacing between said inlet conduit and said side wall to thereby limit the bouncing of said shavings in said separator bowl means and out thereof before being brought up to the speed of rotation of said separator bowl means.

2. A centrifuge according to claim 1, wherein said blade portion terminates at a location axially spaced from said shaving dispensing edge and on a side of said dispensing edge remote from said end wall.

3. A centrifuge according to claim 2, wherein said blade portion includes further blade means secured for movement with respect to said blade portion.

4. A centrifuge according to claim 3, including bearing means on said blade portion, said further blade means being pivotally secured to said bearing means about an axis which is parallel to the axis of rotation of said separator bowl means.

5. A centrifuge according to claim 4, wherein said support means includes a plate lining said bottom wall of said separator bowl means and releasable connecting means for connecting said plate to said separator bowl means, said blade means being mounted on said plate.

6. A centrifuge according to claim 1, including support means for supporting said blade means for movement relative to said separator means whereby wear on the internal wall of said separator bowl means caused by the movement of said metal shavings along a path located at the juncture between the leading side of said blade means and said separator bowl means will be minimized due to said relative movement and a relocating of said path on an unworn section of said internal wall to thereby enhance the lifetime of said separator bowl means.

7. A centrifuge according to claim 1, wherein said inlet conduit is a conical member with downwardly converging walls; and wherein said blade means have a radially inwardly facing edge which is continuously radially outwardly inclined at an acute angle to said end wall.

* * * * *

UNITED STATES PATENT AND TRADEMARK OFFICE

CERTIFICATE OF CORRECTION

PATENT NO. : 4 298 476

DATED : November 3, 1981

INVENTOR(S) : Robert H. Dudley

It is certified that error appears in the above—identified patent and that said Letters Patent is hereby corrected as shown below:

Abstract, line 14; change "form" to ---from---.

Column 6, line 64; change "cut" to ---out---.

Signed and Sealed this

*Thirtieth* Day of *March 1982*

[SEAL]

*Attest:*

GERALD J. MOSSINGHOFF

*Attesting Officer*

*Commissioner of Patents and Trademarks*